US005326280A

United States Patent [19]

Briones et al.

[11] Patent Number: 5,326,280

[45] Date of Patent: Jul. 5, 1994

[54] COAXIAL CONNECTOR WITH INTEGRAL DECOUPLING UNIT

[75] Inventors: Francisco R. Briones, Markham; Kamal S. Boutros, Richmond Hill, both of Canada

[73] Assignee: Amphenol Corporation, Wallingford, Conn.

[21] Appl. No.: 75,876

[22] Filed: Jun. 14, 1993

[51] Int. Cl.[5] ..... H01R 13/00

[52] U.S. Cl. ..... 439/581

[58] Field of Search ..... 439/578-585, 439/620

[56] References Cited

U.S. PATENT DOCUMENTS

| | | | |
|---|---|---|---|
| 3,879,103 | 4/1975 | Peltola et al. | 439/581 |
| 3,980,382 | 9/1976 | Reeder | 439/581 |
| 4,412,717 | 11/1983 | Monroe | 439/581 |
| 4,500,159 | 2/1985 | Briones et al. | 339/147 R |
| 4,772,221 | 9/1988 | Kozlof | 439/549 |
| 4,795,352 | 1/1989 | Capp et al. | 439/581 |
| 4,884,982 | 12/1989 | Fleming et al. | 439/620 |
| 4,934,960 | 6/1990 | Capp et al. | 439/620 |
| 5,062,811 | 11/1991 | Hackman | 439/620 |
| 5,073,123 | 12/1991 | Birch et al. | 439/188 |
| 5,108,300 | 4/1992 | Weber | 439/188 |
| 5,145,412 | 9/1992 | Tan et al. | 439/620 |

FOREIGN PATENT DOCUMENTS

| | | | |
|---|---|---|---|
| 53-86387 | 7/1978 | Japan | H01R 13/12 |

OTHER PUBLICATIONS

National Tel-Tronics product brochure "The New Wave in Coaxial Connectors".

*Primary Examiner*—Joseph H. McGlynn
*Attorney, Agent, or Firm*—Bacon & Thomas

[57] ABSTRACT

A decoupled BNC connector includes an integral decoupling unit in the form of a dielectric main body having a parallelepiped-shaped rear section, a cylindrical front section, an opening through the rear section and front section to receive the cylindrical portion of an outer contact, and a plurality of recesses extending through the rear section of the main body in which are positioned chip capacitors. The chip capacitors are held in the recesses by first and second conductive plate springs, secured to the main body, one of the plate springs biasing the chip capacitors into pressure contact with the other. The first conductive plate spring is sandwiched between the rear section of the main body and a parallelepiped-shaped rear section of the outer contact to establish an electrical connection between the contact and one electrode of the capacitor. The second conductive member includes planar sections secured within slots in the rear section of the main body, and extensions which engage a panel in front of the rear section. The outer contact is secured to the dielectric decoupler main body by an interference fit between a projection on the contact and a groove in the opening of the main body, or the main body may be extended to completely the enclose the parallelepiped-shaped portion of the rear contact, and the decoupler main body secured to the outer contact by an aperture in the main body extension and a latching projection on the outer contact.

75 Claims, 4 Drawing Sheets

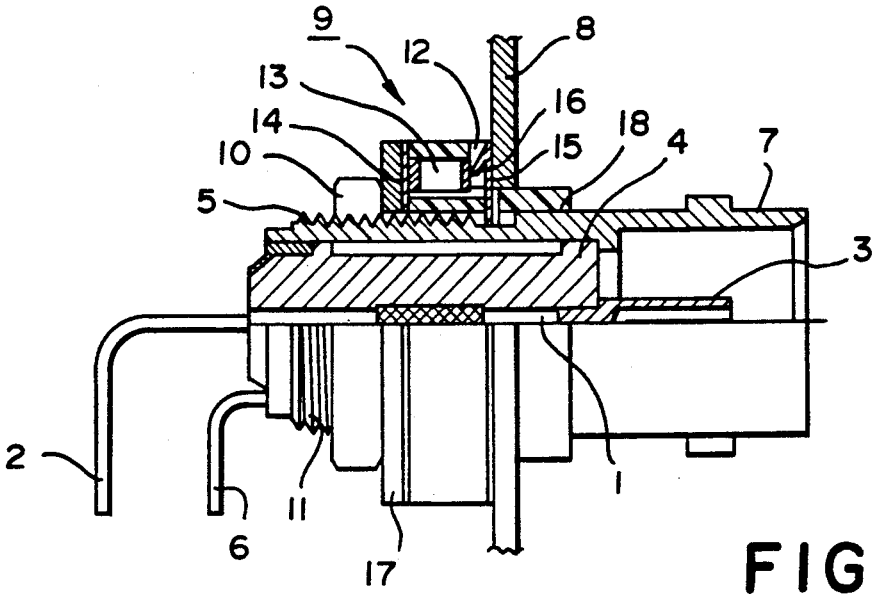
FIG. 1
(PRIOR ART)
FIG. 2(a)
(PRIOR ART)
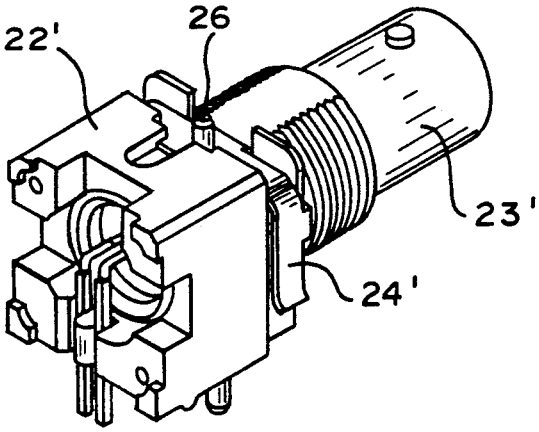
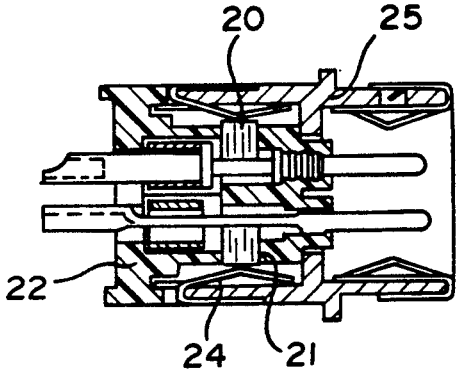
FIG. 2(c)
(PRIOR ART)
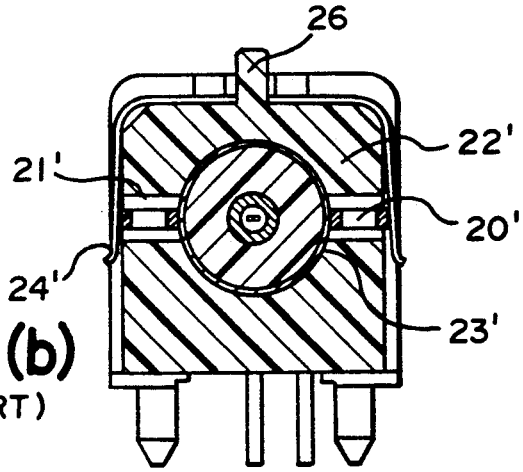
FIG. 2(b)
(PRIOR ART)

FIG. 4
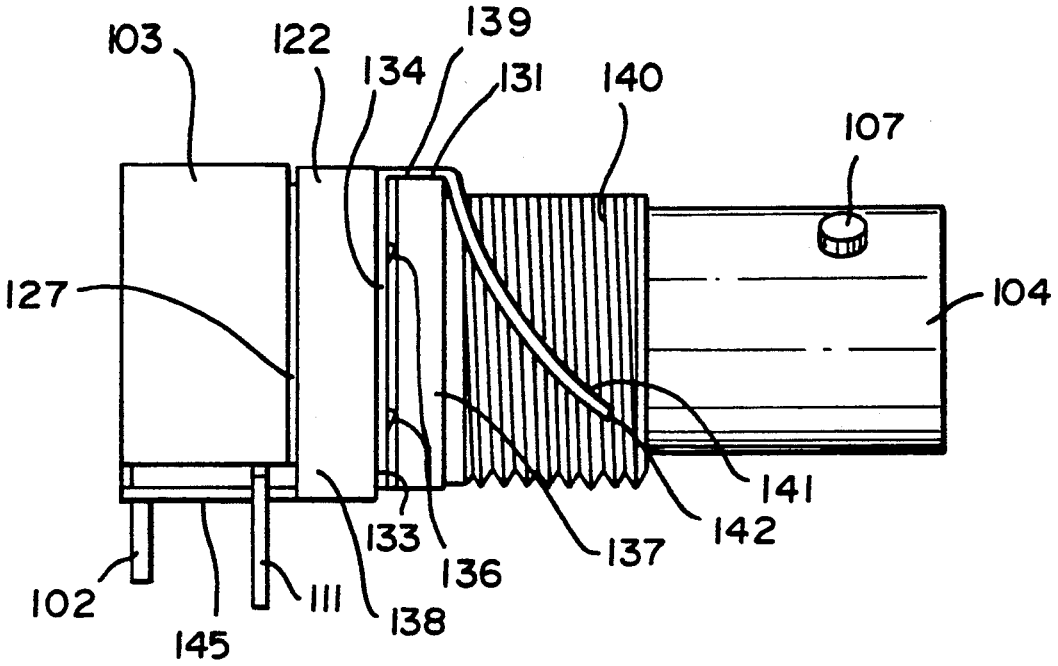
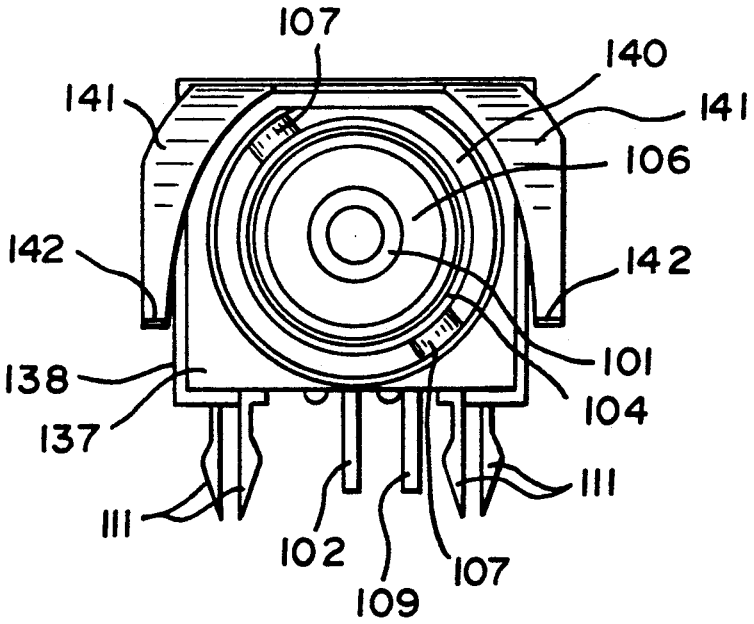
FIG. 5

COAXIAL CONNECTOR WITH INTEGRAL DECOUPLING UNIT

BACKGROUND OF THE INVENTION

1. Field of the Invention

This invention relates to an electrical connector, and in particular to a decoupled BNC connector having an integral decoupling unit.

2. Description of Related Art

A BNC connector is a coaxial cable connector having an inner signal carrying conductor and an outer conductor surrounding the inner conductor which is ultimately connected to the shield of a cable, which is ideally at ground potential. Because shielded cables prevent RF frequency emissions from the cable, BNC configurations are often used for high frequency communications, such as in local area network (LAN) systems. Distinguishing features of the BNC connector include its bayonet coupling, for ease of interconnection, and a small profile, which is critical in LAN applications due to the small size and component densities of the circuit boards which carry LAN interfaces.

Originally, BNC connectors were mounted on a panel extending from the interface board, and the outer contact was directly connected to the panel by engagement between the panel and the outer contact, which formed the profile of the connector. However, a problem with direct grounding is that currents tend to be present in the cable shield due to external fields and differences in potential between ends of the cable. The former currents are known as transients and the latter currents are known as "ground loops". A solution to this problem which involved fitting the capacitor filter within the profile of the connector was first proposed in Amphenol's U.S. Pat. No. 4,772,221 (Kozlof). The Kozlof design enabled decoupling of the connector outer contact from the panel ground while at the same time permitting transients to pass. The present invention represents an improvement on the basic Kozlof design.

An example of a rear mount version of the Kozlof design as applied to a BNC connector having a cylindrical profile is shown in FIG. 1. The Kozlof BNC connector includes an inner contact 1 arranged to be connected to a trace on a circuit board through PCB tail 2, and to the inner conductor of a mating PCB connector through a cylindrical mating portion 3. The inner conductor is surrounded by an insulator member 4, which is secured with an outer conductor 5 having a ground tail 6 and a mating portion 7.

The Kozlof BNC connector is secured to a panel 8 by decoupling ring 9 and a nut 10 which is threaded onto threaded portion 11 of the connector. The decoupling ring includes a cylindrical dielectric having openings 12 in which are inserted chip capacitors 13. The capacitors are held in the housing 12 by washers 14 and 15, washer 15 including tines 16 which bias the capacitors against washer 14 and ensure a continuous electrical path between the panel and the outer conductor 5, the path including washer 15, capacitors 13, washer 14, another washer 17, a nut 10, and outer connector 5, washer 14 being essentially an extension of the outer contact. To ensure that outer contact 5 is not short-circuited to the panel, an insulator 18 is fitted between the panel 8 and around outer contact 5. The capacitors 13 are securely held in the decoupling ring, which at the same time facilitates assembly by permitting the decoupler ring to be fitted on the outer contact as a unit to form the connector profile.

Despite its advantages, however, the Kozlof connector has proved difficult to adapt to a second type of BNC connector which had a rectangular or parallelepiped-shaped dielectric outer housing rather than a cylindrical profile. The initial solution to the problem of decoupling a parallelepiped-shaped BNC connector, described in a published 1987 sales brochure by NTT corporation, and embodied in a connector sold at the time, was to place the chip capacitors directly within a recess in the outer dielectric body rather than in a discrete decoupling member, and to effect electrical connection to the panel by a panel engaging washer fitted over the capacitor recess. A conductive resilient member was placed between the capacitor and the outer conductor to ensure contact between the capacitor, the outer conductor, and the washer. Another decoupled parallelepiped shaped BNC connector was proposed in U.S. Pat. No. 4,884,982 to Fleming et al., shown in FIGS. 2(*b*) and 2(*c*). In this connector the capacitors are held in place by a resilient member which clipped the capacitors against the outer contact of the connector from the outside.

Both the NTT and Fleming designs have in common the use of an essentially externally mounted structure a hold s chip capacitor in a recess against a contact, utilizing a concept similar to that proposed several years earlier in U.S. Pat. No. 4,500,159 to Briones. In the Briones design, shown in FIG. 2(*a*), the chip capacitors 20 are fitted within openings 21 of a dielectric body 22 and biased against the contact 23 by means of a clip 24 supported by the outer conductive housing 25 of the connector. The present invention, in contrast, seeks to adapt the principle of using decoupling chip capacitors to a rectangular or parallelepiped shaped BNC connector by using the more integrated design of Kozlof in order to provide a structure which is easier to assemble and of greater mechanical stability than the prior designs.

SUMMARY OF THE INVENTION

The present invention seeks to provide an improved means for capacitively decoupling a coaxial connector by modifying the Kozlof ring design in order to more completely integrate the decoupler within the body of the connector. The portion of the connector which houses the capacitors is a unitary structure in which each capacitor is securely positioned between two conductive members fixedly attached, without the need for heat staking or other cumbersome process steps, to a unique insulator member which forms both a decoupling structure and the other body of the connector. Furthermore, the decoupling structure of the invention is generally applicable to a wide variety of connectors, including twin axial and tri-axial connectors, and may be used with components other than capacitors, such as spark gaps, and for purposes other than decoupling or filtering.

More specifically, the invention provides an electrical connector having at least one contact which is to be electrically connected through at least one electrical component, the electrical component having electrodes on opposite sides, to a conductive device or member such as a panel external to the connector. The connector further includes a dielectric member which surrounds at least a portion of the contact and which includes a recess in which the component is supported, a first conductive member secured to the dielectric member to engage one electrode of the component, and a second conductive member secured to the dielectric body to engage the second electrode and sandwich the component therebetween. Finally, the connector includes means for electrically connecting the first conductive member to the contact and for electrically connecting the second conductive member to the external conductor, and means for fixedly securing the dielectric member to the outer contact. Although applicable to a wide variety of connectors, in an especially preferred embodiment of the invention, the external conductor is a panel and the decoupler body provides means for securing the decoupler body to the panel. In this embodiment, one of conductive members include the tongue or extension which extends forwardly of the decoupler body to engage the panel, and a vertical portion which fits within a slot provided in the main body to secure the conductive member to the body and provide a rigid surface against which the capacitors are biased.

According to another aspect of the invention, the invention provides an electrical connector having at least one contact which is to be electrically connected through at least one electrical component having electrodes on opposite sides to a conductor external to the connector, a dielectric member having a central opening for at least a portion of the contact and including a recess in which the component is supported, a first conductive member secured to the dielectric member to engage one electrode of the component, a second conductive member secured to the dielectric member to engage the second electrode and sandwich the component therebetween, means for electrically connecting the first conductive member to the contact, and means for electrically connecting the second conductive member to the external conductor, and wherein the recesses in which the components are situated do not communicate with the central opening, and are in fact are parallel thereto.

According to yet another advantageous aspect of the invention, an electrical connector is provided which includes an integral dielectric decoupler body, at least one recess for an electrical component, means for securing the electrical component in the decoupler body, and means for connecting electrodes of the electrical component to, respectively, the electrical contact and an external conductor.

BRIEF DESCRIPTION OF THE DRAWINGS

FIG. 1 is a side view, partially in cross-section, of a BNC connector with a separate decoupling unit in the form of a decoupling ring.

FIG. 2(*a*) is a cross-sectional side view of an electrical connector in which a chip capacitor is held in pressure contact with an electrical contact in the connector by a conductive clip within the outer profile of the conductor.

FIG. 2(*b*) is a cross-sectional front view of another electrical connector in which a chip capacitor is held in pressure contact with an electrical contact in the connector by a conductive clip within the profile of the connector.

FIG. 2*c* is a perspective view of the electrical connector of FIG. 2(*b*).

FIG. 4 is an elevated side view of the preferred connector of FIG. 3.

FIG. 5 is an elevated front view of the preferred connector of FIG. 3.

DETAILED DESCRIPTION OF THE PREFERRED EMBODIMENTS

Figure 3:
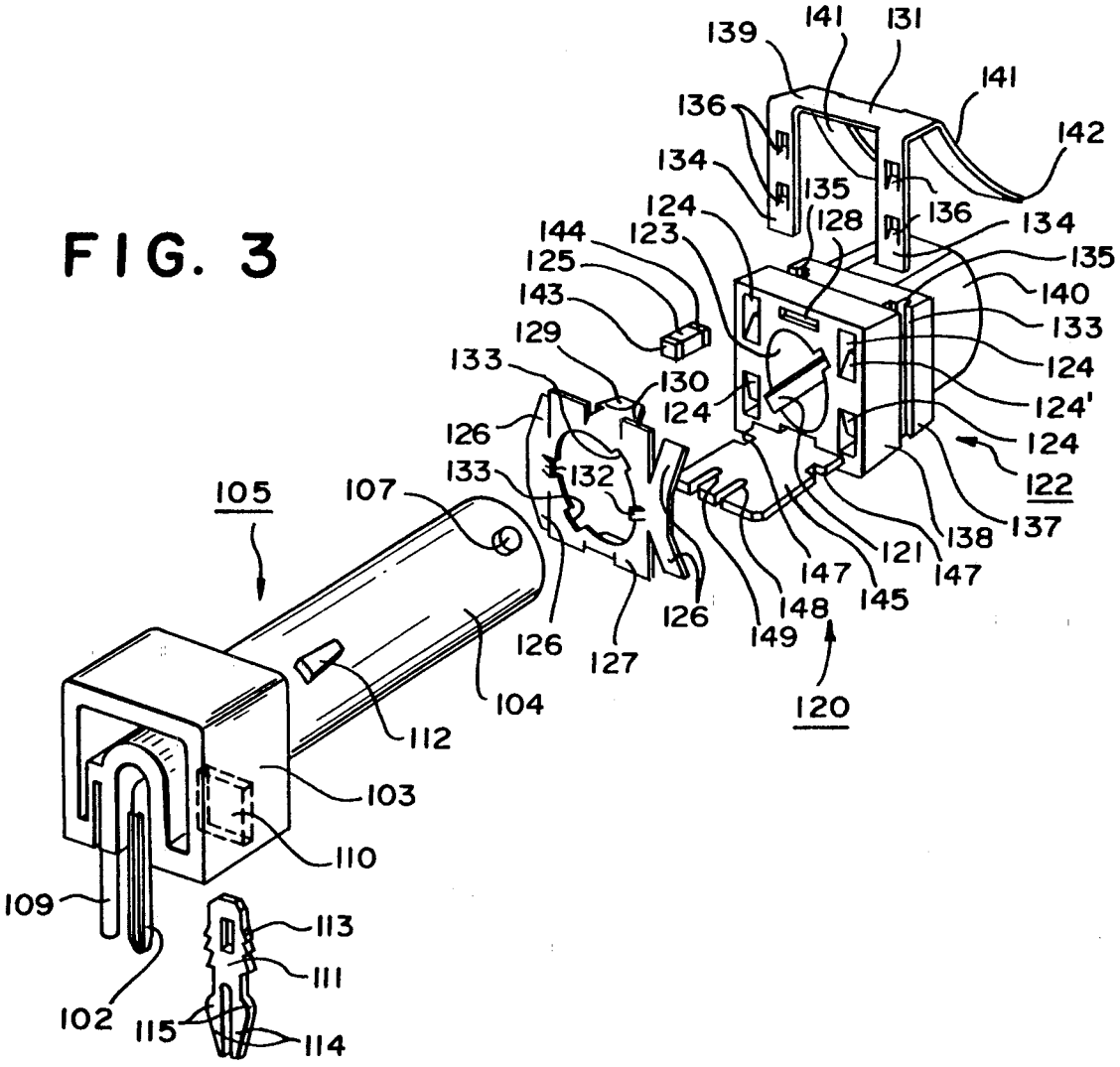
FIG. 3 is an exploded perspective view of a BNC connector having an integral decoupling unit in accordance with a first preferred embodiment of the invention.

FIGS. 3–5 show a BNC connector having an integral decoupling unit according to a first preferred embodiment of the invention. The BNC connector of FIGS. 3–5 includes an inner contact 101 having a right-angled PCB tail 102 for electrical connection to a trace on a printed circuit board, and a mating section positioned within a cylindrical forward section 104 of an outer contact 105 for receiving the inner signal contact of a complementary mating connector attached to a coaxial cable. The outer contact 105 of the preferred connector surrounds inner contact 101 and is insulated therefrom by an insulator member 106, forward section 104 including a conventional bayonet pin 107 to facilitate attachment to the mating connector. It will be appreciated by those skilled in the art that the elements described so far are completely conventional.

Outer contact 105, in addition to the conventional forward section 104, includes a unique rear section 103 in the shape of a parallelepiped from which extends a right-angled ground tail 109 for electrical connection to the ground trace on the circuit board, and two boardlock slots 110 (only one of which is shown) in which are fitted board locks 111 for mounting the BNC connector on a circuit board. Boardlocks 111 replace the standard mounting post conventionally used on this type of connector.

A decoupling unit 120, described in greater detail below, is secured to the outer contact by a detent member 112 which projects from a rear portion of the cylindrical portion of the contact in order to secure the outer contact 105 to the decoupling unit 120. Detent member 112 is wedge shaped with a gradually increasing width towards the rear of the connector, such that the width at the rear of the detent member is wider than that of bayonet pin 107. As a result, bayonet pin 107 will pass without interference through a slot or groove 121 of appropriate width provided in the decoupler body member 122, while the detent member 112 becomes wedged therein to secure the body member of contact 105 when body member 122 is fitted over the contact. Boardlocks 111 include similar projections 113 for securing the boardlocks in slots 110, and also tines 114 which flex to permit sections 115 to pass through mounting holes in the circuit board, sections 115 flexing outwardly upon insertion into the holes to lock the connector onto the board while compensating for tolerances in the size of the mounting holes.

Dielectric main body member 122 includes an opening 123 for outer contact 105, with slots 121 being situated in a perimeter of the opening for receiving bayonet pin 107 and detent members 112 as described above. Main body member 122 also includes four recesses 124 extending parallel to a principal axis of opening 123, and therefore to a principal axis of the contact, without communicating therewith. Because these recesses 124 do not communicate with the opening 123 or the exterior of the connector, both ends of the chip capacitors 125 may be secured within the decoupling member and the decoupling unit may be made detachable from the contact, while nevertheless providing a decoupled BNC connector having an integral decoupling unit which is fully interchangeable with standard BNC connectors.

Recesses 124 include enlarged openings 124' at the rear of the recesses for receiving the chip capacitors 125, and also for receiving tines 126 on a first conductive member 127. It will be appreciated by those skilled in the art that chip capacitors 125 may be replaced by a variety of other electrical components, including spark gap members of the type described in U.S. patent application Ser. No. 07/890,261.

Main body member also includes a slot 128 for receiving an extension 129 of the first conductive member. Extension 129 is formed with barbs 130 for securing the first conductive member to the main body member after placement of chip capacitors 125 into recesses 124. First conductive member 127 is made of a resilient plate spring material such that tines 126, which extend from the principal plane of the conductive member, bias the chip capacitors 125 against a second conductive member 131. Tines 132, which extends rearwardly from the principal plane of the first conductive member, ensure that electrical contact is maintained between rear section 108 of contact 105 when the first conductor member 107 is pressed thereagainst upon placement of decoupler body member 122 over contact 105. First conductive member 107 also includes notches 133 for permitting detent members 112 and bayonet pins 107 to pass when assembling the decoupler unit 120 onto the outer contact 105.

Main decoupler body 122 further includes slots 133 for receiving legs 134 of the second conductive member 131 and which are in communication with recesses 124. Within slots 133 are located grooves 135 for receiving tines 136 which extend forwardly from legs 134 so as to engage the sides of grooves 135 and secure legs 134 within slots 133. The second conductor member 131 is also in the form of a conductive plate spring, but because of its placement in the slots 133, the legs 134 present an essentially rigid surface against which the capacitors are biased by the first conductive member.

Main body 122 has a generally parallelepiped shaped, but the section or portion 137 of main body 122 which extends forwardly of slots 133 is smaller in cross sectional area than a section or portion 138 which extends rearwardly from the slots, in order to accommodate connecting portion 139 of the second conductive member 131 so that the overall perimeter of sections 137 and 138 of main body 122, together with second conductive member 131, does not exceed that of rear section 108 of the outer contact 105.

Extending forwardly from rear section 138 of main body 122 is substantially cylindrical portion 140 which extends through a standard BNC connector opening in a panel to insulate the outer contact 105 from the panel. Section 140 may include threads for a coupling nut which is threaded onto the section after it has been inserted through the panel opening to mount the connector on the panel, although those skilled in the art will appreciate that the conductor need not be secured to the panel, but rather may be mounted solely by fitting boardlocks 111 onto the circuit board and securing PCB tail 102 and ground tail 109 to appropriate traces.

Electrical connection to the panel is effected by including tongues 141 in the second connector member 107 which extend forwardly and laterally outside the profile of the connector to engage the circuit board. By extending the tongues 141 in this manner, good contact with the panel is ensured despite tolerances in mounting the connector relative to the panel. Preferably, the actual point of contact of the panel is a sharp edge 142 on tongue 141 shaped to penetrate the oxide layer which ordinarily forms on panels of this type and thus ensure a good electrical connection. The electrical path provided by the decoupler structure therefore extends from contact 105 through first conductor member 127, electrode 143 of chip capacitor 125, electrode 144, second conductive member 131, and to the panel via extensions 141 and edges 142.

In order to insulate the rear section 108 of outer contact 105 from traces on the circuit board, a dielectric member 145 is fitted into a slot 146 in main body 122 to form the base of section 108. Member 145 includes notches 147 for receiving portions of board lock 111, and notches 148 and 149 for respectively accommodating inner conductor PCB tail 102 and ground tail 109.

Those skilled in the art will appreciate that by providing recesses 124 which do not directly communicate with the outer contact or the exterior of the connector, there is no chance, once the capacitors 125 have been positioned within the recesses and sandwiched by the first and second capacitor members, that they can be accidentally removed from the recesses. Furthermore, if removal is desired, the entire decoupling unit need only be removed from the outer contact by overcoming the frictional interference fit provided by detent member 112, at which time the first conductive member can easily be removed and the electrical components in the recesses repaired or replaced.

Figure 6:
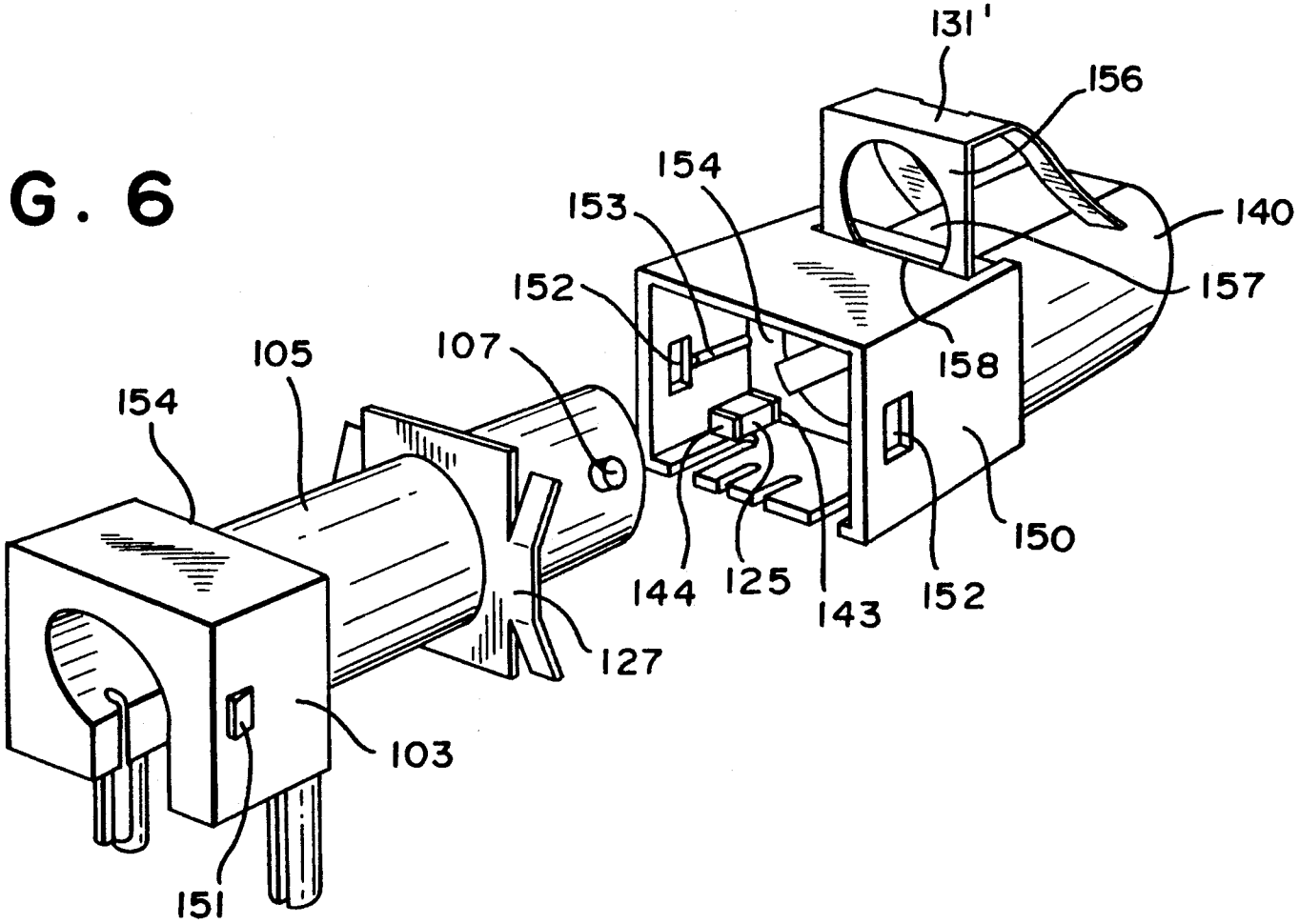
FIG. 6 is an exploded perspective view of a BNC connector having an integral decoupling unit according to a second preferred embodiment of the invention.

In the embodiment of FIGS. 3–5, sections 137 and 138 of the dielectric main body of the coupler and the parallelepiped-shaped rear section 108 of the outer contact together form an outer profile which essentially matches that of the prior NTT-type decoupled BNC connector. However, a completely insulated rear portion can also be provided, as shown in FIG. 6. In this embodiment, the need for dielectric member 145 is eliminated by extending main body 122 to include a hollow parallelepiped-shaped rear section 150 which fits over section 103 of outer contact 105, the perimeter of section 103 preferably having been reduced to accommodate section 150. The decoupling unit 101 is secured to the outer contact 105 by wedge-shaped latching projections 151 which snap into latching apertures 152 in rear section 150. The first conductive member 127 is held in place by an interference fit with ribs 153 in section 150, as well as being sandwiched between rear section 103 of outer contact 105 and rear surface 154 of main decoupling unit body member 122. Finally, in this embodiment, a modified second conductive member 131' has a mounting portion in the form of a planar section 156 having a circular opening 157 therein, either with a diameter large enough to pass bayonet pin 107 or notches provided for that purpose. The interior of member 122 contains grooves (not shown) for receiving edges of planar section 157 after having been inserted through slot 158.

Having thus described two specific embodiments of the invention in sufficient detail to enable one skilled in the art to make and use the invention, it will nevertheless be appreciated by those same skilled artisans that numerous variations on the basic concepts of providing an integral but removable decoupling unit, in which the capacitors are mounted in recesses where they can be securely sandwiched between two conductive members, are possible. Consequently, it is intended that the invention not be limited by the above description or by the drawing figures, but rather that it be defined solely in accordance with the amended claims.

I claim:

1. An electrical connector having at least one contact connected through at least one electrical component having first and second electrodes to a conductor external to the connector, comprising:

a dielectric member which surrounds at least a portion of the contact and which includes a recess for supporting the component therein;

a first conductive member secured to the dielectric member to engage the first electrode of the component;

a second conductive member secured to the dielectric body to engage the second electrode of the component and sandwich the component therebetween;

means for electrically connecting the first conductive member to the contact;

means for electrically connecting the second conductive member to the external conductor; and means on said dielectric member and on said contact for fixedly securing the dielectric member to the outer contact.

2. A connector as claimed in claim 1, wherein said dielectric body includes a hollow parallelepiped-shaped rear section which fits over a parallelepiped-shaped rear section of said contact, said dielectric body rear section being secured to said contact by engagement between a projection on said contact rear section and a latching aperture in said dielectric body rear section.

3. A connector as claimed in claim 1, wherein said connector is a rear-mount BNC connector.

4. A connector as claimed in claim 1, wherein said electrical component is a chip capacitor.

5. A connector as claimed in claim 1, wherein said dielectric body comprises an opening defined by a surface having substantially the same longitudinal axis and cross-sectional shape as the contact extending therethrough, and wherein said securing means comprises a groove in said surface extending parallel to said longitudinal axis, and a projection on said contact shaped to provide an interference fit with said groove when said detent on said contact is inserted in said groove.

6. The connector as claimed in claim 5, wherein said contact is cylindrical.

7. A connector as claimed in claim 5, wherein said first conductive member is a plate spring having an opening identical in shape to a transverse cross-section of said opening in said dielectric body and a notch in a perimeter of said opening identical in shape to a transverse cross-section of said groove.

8. A connector as claimed in claim 7, wherein said first conductive member further comprises a time extending into said recess to engage said first electrode of said component.

9. A connector as claimed in claim 8, further comprising second, third and fourth recesses in said dielectric body and respective second, third and fourth tines extending into said second, third, and fourth recesses to engage respective first electrodes of said second, third, and fourth components in said recesses.

10. A connector as claimed in claim 8, wherein said first conductive member further comprises a barbed projection extending therefrom and wherein the dielectric member includes a slot for receiving the projection to attach said first conductive member to said dielectric member.

11. A connector as claimed in claim 5, wherein said contact has a cylindrical portion which fits within said opening a rear section in the shape of a parallelepiped, said first conductive member having a square shape having substantially the same outer dimensions as that of the rear section of the contact, and said dielectric member also having a rear section in the shape of a parallelpiped, said first conductive member being sandwiched between said rear sections of said contact and said dielectric body.

12. A connector as claimed in claim 11, wherein said conductive member comprises a planar section, and said dielectric body includes a slot in which said planar section is fitted, said recess communicating with said slot such that said second electrode of said component engages said second conductive member, and is held in pressure contact therewith by said first conductive member.

13. A connector as claimed in claim 12, wherein said second conductive member further comprises an extension which forms said second connection means, said extension extending beyond an outer profile of said rear section of said dielectric body, both forwardly and laterally.

14. The connectors as claimed in claim 13, wherein said second conductive member further comprises a second extension which also forms part of said second connection means, and a second planar section, said dielectric member including a second slot in which said second planar section is fitted, and a connecting section connecting said first and second extensions and said first and second planar sections.

15. The connector as claimed in claim 10, wherein said planar section further comprises barbs for securing said second conductive member in said slot.

16. A connector as claimed in claim 13, wherein said dielectric member includes a substantially cylindrical portion extending from a parallelepiped shaped rear section, said substantially cylindrical portion having a shape corresponding to that of a panel opening, said extension engaging said panel.

17. A connector as claimed in claim 16, wherein said cylindrical portion is threaded to receive a nut for securing said connector to the panel.

18. A connector as claimed in claim 16, wherein said contact is the outer contact of a BNC connector, and further comprising an inner contact extending within the outer contact, said inner contact having a PCB tail extending from said rear section of said outer contact for electrical connection to a first trace on a printed circuit board, and said outer contact also including a PCB tail for electrical connection to a second trace on the printed circuit board.

19. A connector as claimed in claim 18, wherein said PCB tails are at right angles to principal longitudinal axes of said inner and outer contacts.

20. A connector as claimed in claim 19, wherein said rear section further comprises means for defining a slot for receiving a boardlock for mounting said connector on the printed circuit board.

21. A connector as claimed in claim 1, wherein said second conductive member further comprises an extension which forms said second connection means, said extension extending beyond an outer profile of a rear section of said dielectric member both laterally and forwardly.

22. A connector as claimed in claim 21, wherein said second conductive member comprises a planar section, and said dielectric body includes a slot in which said planar section is fitted, said recess communicating with said slot such that second electrode of said component engages said second conductive member, and is held in pressure contact therewith by said first conductive member.

23. A connector as claimed in claim 22, wherein said second conductive member further comprises a second extension which also forms part of said second connection means, and a second planar section, said dielectric member including a second slot in which said second planar section is fitted, and a connecting section connecting said first and second extensions and said first and second planar sections.

24. A connector as claimed in claim 22, wherein said planar section further comprises barbs for securing said second conductive member in said slot, said second conductive member supported by said slots forming a rigid structure against which the component is biased by said first conductive member.

25. A connector as claimed in claim 24, wherein said first conductive member further comprises a tine extending into said recess to engage said first electrode of said component.

26. A connector as claimed in claim 25, further comprising second, third, and fourth recesses in said dielectric body and respective second, third and fourth tines extending into said second, third, and fourth recesses to engage respective first electrodes of said second, third and fourth components in said recesses.

27. A connector as claimed in claim 24, wherein said first conductive member further comprises a barbed projection extending therefrom, and wherein the dielectric member includes a slot for receiving the projection to secure said first conductive member to said dielectric member.

28. A connector as claimed in claim 27, wherein said contact has a cylindrical portion which fits within said opening and a rear section in the shape of a parallelepiped, said first conductive member having a square shape having substantially the same outer dimensions as that of the rear section of the contact, and said dielectric member also having a rear section in the shape of a parallelepiped congruent to the first parallelepiped, said first conductive member being sandwiched between said rear sections of said contact and dielectric body.

29. An electrical connector having at least one contact electrically connected through at least one electrical component to a conductor external to the connector, comprising:

a dielectric member which includes a recess for supporting the component and an opening in which at least a portion of the contact is fitted;

a first conductive member affixed to the dielectric member to engage a first electrode of the component;

a second conductive member secured to the dielectric body to engage a second electrode of the component and sandwich the component therebetween;

means for electrically connecting the first conductive member to the contact and means for electrically connecting the second conductive member to the external conductor, wherein one end of said recess in said dielectric member communicates with a slot in the dielectric member in which the second conductive member is fitted, said recess extending parallel to a longitudinal axis of the opening such that a second end of said recess communicates with a rear surface of the dielectric member to which the first conductive member is affixed.

30. A connector as claimed in claim 29, wherein said dielectric body includes a hollow parallelepiped-shaped rear section which fits over a parallelepiped-shaped rear section of said contact, said dielectric body rear section being secured to said contact by engagement between a projection on said contact rear section and a latching aperture in said dielectric body rear section.

31. A connector as claimed in claim 29, wherein said first conductive member further comprises a barbed projection extending therefrom and wherein the dielectric member includes a slot for receiving the projection to secure said first conductive member to said dielectric member.

32. A connector as claimed in claim 29, wherein said first conductive member further comprises a tine extending into said recess to engage said first electrode of said component.

33. A connector as claimed in claim 32, further comprising second, third and fourth recesses in said dielectric body said respective second, third and fourth tines extending into said second, third, and fourth recesses to engage respective first electrodes of said second, third, and fourth components in said recesses.

34. A connector as claimed in claim 32, wherein said first conductive member further comprises a barbed projecting extending therefrom and wherein the dielectric member includes a slot for receiving the projection to attach said first conductive member to said dielectric member.

35. A connector as claimed in claim 29, wherein said contact has a cylindrical portion which fits within said opening and a rear section in the shape of a parallelepiped, said first conductive member having a square shape with substantially the same outer dimensions as that of the rear section of the contact, and said dielectric member also having a rear section in the shape of a parallelepiped, said first conductive member being sandwiched between said rear sections of said contact and said dielectric body.

36. A connector as claimed in claim 35, wherein said second conductive member comprises a planar section, and said dielectric body includes a slot in which said planar section is fitted, said recess communicating with said slot such that said second electrode of said component engages said second conductive member, and is held in pressure contact therewith by said first conductive member.

37. A connector as claimed in claim 36, wherein said second conductive member further comprises an extension which forms said second connection means, said extension extending outside said rear section of said dielectric body, both forwardly and laterally.

38. The connector as claimed in claim 37, wherein said second conductive member further comprises a second extension which also forms part of said second connection means, and a second planar section, said dielectric member including a second slot in which said second planar section is fitted, and a connecting section connecting said first and second extensions and said first and second planar sections.

39. The connector as claimed in claim 37, wherein said planar section further comprises barbs for securing said second conductive member in said slot.

40. A connector as claimed in claim 37, wherein said dielectric member includes a substantially cylindrical portion extending from a parallelepiped shaped rear section, said substantially cylindrical portion having a shape corresponding to that of a panel opening, said extension engaging said panel.

41. A connector as claimed in claim 29, wherein said contact is the outer contact of a BNC connector and further comprising an inner contact extending within the outer contact, said inner contact having a PCB tail extending from said rear section of said outer contact for electrical connection to a first trace on a printed circuit board, and said outer contact also including a PCB tail for electrical connection to a second trace on the printed circuit board.

42. A connector as claimed in claim 41, wherein said PCB tails are at right angles to principal longitudinal axes of said inner and outer contacts.

43. A connector as claimed in claim 42, wherein said rear section further comprises means for defining a slot for receiving a board lock for mounting said connector on the printed circuit board.

44. A connector as claimed in claim 29, wherein said second conductive member further comprises an extension which forms said second connection means, said extension extending beyond a profile of outside said rear section of said dielectric body both laterally and forwardly.

45. A connector as claimed in claim 44, wherein said second conductive member further comprises a second extension which also forms part of said second connection means, and first and second planar sections, wherein said first planar section fits within the first slot and said dielectric member includes a second slot in which said second planar section is fitted, and a connecting section connecting said first and second extension and said first and second planar sections.

46. A connector as claimed in claim 29, wherein said second conductive member comprises a planar section fitted into said slot, said recess communicating with said slot such that second electrode of said component engages said second conductive member, and is held in pressure contact therewith by said first conductive member.

47. A connector as claimed in claim 46, wherein said first and second planar section further comprise barbs for securing said second conductive member in said slots, said second conductive member supported by said slots forming a rigid structure against which the component is biased.

48. A connector as claimed in claim 46, wherein said first conductive member is a plate spring having an opening identical in shape to said opening in said dielectric body and a notch in a perimeter of said opening corresponding to said opening.

49. A connector as claimed in claim 46, wherein said first conductive member further comprises a tine extending into said recess to engage said first electrode of said component and bias the component against said planar section of the second conductive member.

50. A connector as claimed in claim 49, further comprising second, third, and fourth recesses in said dielectric body and respective second, third and fourth tines extending into said second, third, and fourth recesses to engage respective first electrodes of said second, third, and fourth components in said recesses.

51. A connector as claimed in claim 29, wherein said contact has a cylindrical portion which fits within said opening and a rear section in the shape of a parallelepiped, said first conductive member having a square shape with substantially the same outer dimensions as the rear section of the contact, and said dielectric member also having a rear section in the shape of a parallelepiped congruent to the first parallelepiped, said first conductive member being sandwiched between said rear sections of said contact and dielectric body.

52. A connector as claimed in claim 51, wherein said connector is a rear-mount BNC connector.

53. A connector as claimed in claim 29, wherein said electrical component is a chip capacitor.

54. A connector as claimed in claim 53, further comprising means for removably securing the decoupler body to the outer contact.

55. A connector as claimed in claim 54, wherein said dielectric body comprises an opening defined by a surface having substantially the same longitudinal axis and cross-sectional shape as the contact extending therethrough, wherein said securing means comprises a groove in said surface extending parallel to said longitudinal axis, and a projection on said contact shaped to provide an interference fit with said groove when said projection is inserted into said groove.

56. A connector as claimed in claim 29, wherein said connector is a rear mount BNC connector.

57. A connector as claimed in claim 56, wherein said electrical component is a chip capacitor.

58. An electrical connector, comprising:

an electrical contact; and an integral decoupler, wherein said integral decoupler comprises a dielectric body member, a pair of plate springs affixed to said body member, recesses extending through said body member to communicate with said plate springs, and electrical components in said recesses sandwiched between said conductive members, and wherein said electrical contact includes a rear section having a perimeter substantially the same as that of the decoupler, wherein said first plate spring is sandwiched between said rear section of said electrical contact and said body member of said decoupler.

59. A connector as claimed in claim 58, wherein said electrical components are chip capacitors.

60. A connector as claimed in claim 58, wherein said connector is a BNC connector, said dielectric body member and said first section of said electrical contact are parallelepipeds, wherein a substantially cylindrical front section of said contact extends through an opening in said dielectric body, and wherein said dielectric body also includes a substantially cylindrical front section.

61. A connector as claimed in claim 60, further comprising means for mounting said main body on a printed circuit board.

62. A connector as claimed in claim 60, wherein said electrical components are chip capacitors.

63. A decoupler for an electrical connector, comprising:

a dielectric main body including a parallelepiped-shaped rear section and a cylindrical front section shaped to fit through a panel opening;

a central opening extending through the rear section and the front section;

recesses extending from one planar surface of the rear section to a second planar surface of the rear section;

a first conductive member secured to the first planar surface of the rear section;

a second conductive member secured to the second planar surface of the rear section; and an electrical component sandwiched between said conductive members.

64. A decoupler as claimed in claim 63, wherein said cylindrical portion of said dielectric member is threaded to receive a nut for securing said decoupler to a panel.

65. A decoupler as claimed in claim 63, further comprising means in said dielectric body for engaging in an interference fit a projection on the outer contact of a BNC connector to removably secure said main body to said outer contact and thereby form an integral decoupled BNC connector.

66. A decoupler as claimed in claim 63, further comprising a hollow parallelepiped-shaped extension of said main body, and means defining an aperture for receiving a latching projection of a parallelepiped-shaped rear section of an electrical contact which fits within said extension.

67. A decoupler as claimed in claim 63, wherein said first conductive member is a plate spring having an opening identical in shape to a transverse cross-section of said opening in said dielectric body.

68. A decoupler as claimed in claim 67, wherein said second conductive member comprises a planar section, and said dielectric body includes a slot in which said planar section is fitted, said recess communicating with said slot such that said second electrode of said component engages said second member, and is held in pressure contact therewith by said first conductive member.

69. A decoupler as claimed in claim 67, wherein said first conductive member further comprises a tine extending into said recess to engage said first electrode of said component.

70. A decoupler as claimed in claim 69, further comprising second, third and fourth recesses in said dielectric body and respective second, third, and fourth tines extending into said second, third, and fourth recesses to engage respective first electrodes of second, third, and fourth components of said recesses.

71. A decoupler as claimed in claim 69, wherein said first conductive member further comprises a barbed projection extending therefrom, and wherein the dielectric member includes a slot for receiving the projection to secure said first conductive member to said dielectric member.

72. A decoupler as claimed in claim 63, wherein said second conductive member comprises a planar section, and said dielectric body includes a slot in which said planar section is fitted, said recess communicating with said slot such that said second electrode of said component engages said second conductive member and is held in pressure contact therewith by said first conductive member.

73. A decoupler as claimed in claim 72, wherein said second conductive member further comprises an extension which forms said second connection means, said extension extending outside said rear section of said dielectric member.

74. A decoupler as claimed in claim 73, wherein said second conductive member further comprises a second extension which also forms part of said second connection means, and a second planar section, said dielectric member including a second slot in which said second planar section is fitted, and a connecting section which connects said first and second extensions and said first and second variable sections.

75. A decoupler as claimed in claim 74, wherein said vertical section further comprises barbs for securing said second conductive member in said slot.

* * * * *